US005259663A

United States Patent [19]

Ambasz

[11] Patent Number: 5,259,663

[45] Date of Patent: Nov. 9, 1993

[54] CHAIR SEAT MOUNTING MECHANISM

[76] Inventor: Emilio Ambasz, 295 Central Park West, New York, N.Y. 10024

[21] Appl. No.: 770,103

[22] Filed: Oct. 2, 1991

[30] Foreign Application Priority Data

Oct. 24, 1990 [IT] Italy ..... 21855 A/90

[51] Int. Cl.[5] ..... A47C 3/026

[52] U.S. Cl. ..... 297/302; 297/304; 297/328

[58] Field of Search ..... 297/300, 302, 304, 325-328

[56] References Cited

U.S. PATENT DOCUMENTS

| | | | |
|---|---|---|---|
| 3,989,297 | 11/1976 | Kerstholt | 297/300 |
| 4,364,605 | 12/1982 | Meitler | 297/300 |
| 4,852,943 | 8/1989 | Roper | 297/302 |
| 4,909,472 | 3/1990 | Piretti | 297/302 X |
| 4,948,198 | 8/1990 | Crossman et al. | 297/302 X |

FOREIGN PATENT DOCUMENTS

| | | | |
|---|---|---|---|
| 108908 | 11/1939 | Australia | 297/302 |
| 69410 | 1/1983 | European Pat. Off. | 297/300 |
| 11707 | 10/1990 | World Int. Prop. O. | 297/302 |

*Primary Examiner*—Peter R. Brown

*Attorney, Agent, or Firm*—Brumbaugh, Graves, Donohue & Raymond

[57] ABSTRACT

A chair seat mounting mechanism includes a stationary base member adapted to be mounted on a chair base, a seat-mounting member that is adapted to be attached to a chair seat and is rotatably attached to the base member by a pivot shaft and springs acting between the base member and the seat-mounting member and biasing the seat to a neutral position intermediate of a forward tilted position and a rearward tilted position. An intermediate member is pivotally attached to the pivot shaft, and at least one first spring is engaged between the intermediate member and the seat-mounting member such as to bias the seat-mounting member relative to the intermediate member toward the neutral position and to permit the seat to tilt forward against the bias. At least one second spring is engaged between the base member and the intermediate member such as to bias the intermediate member relative to the base member toward the neutral position and to permit the seat to tilt rearward against the bias. The pivot shaft is spaced apart a substantial distance from the center of the chair seat in the direction of the front edge of the seat bottom so as to limit the amount of vertical motion of the front edge when the seat tilts forward and backward from the neutral position.

9 Claims, 4 Drawing Sheets

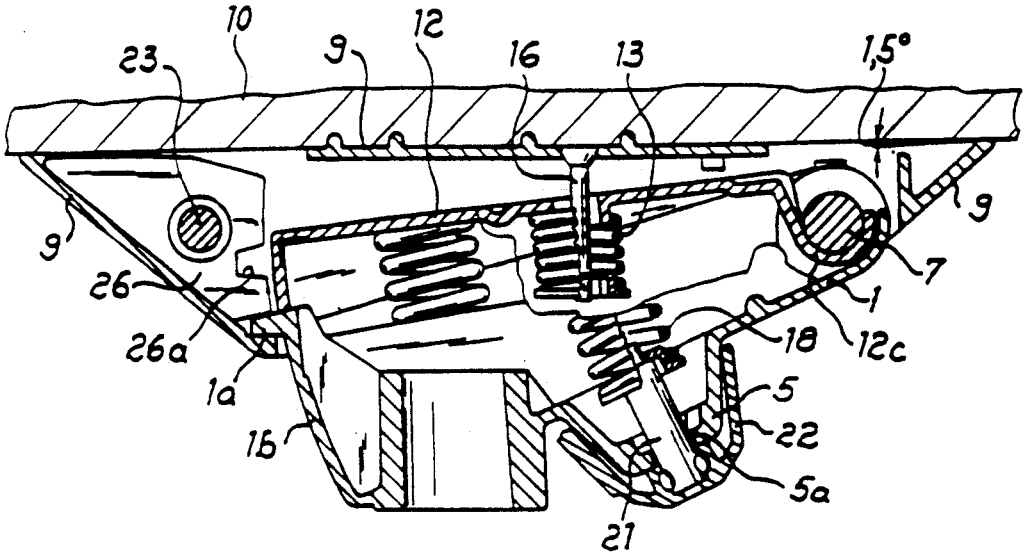

CHAIR SEAT MOUNTING MECHANISM

BACKGROUND OF THE INVENTION

The present invention relates to a mounting mechanism for the seats of office chairs and, in particular, to a mounting mechanism that permits the seat to tilt both forward and backward.

There is an increasingly felt need in the office furniture field for chairs that tilt not only backward, which have long been widely available, but also tilt forward. This need has arisen primarily because of the widespread use of computer and word-processing systems by both office staff and management. It has become necessary to have chairs that afford a comfortable and ergonomically correct position under conditions of normal writing at one's table or desk and under conditions of operating a computer keyboard, which is usually located at a height lower than desk-top level. Lastly, there is also a need for office chairs that provide a slightly backward tilted position of active rest.

A number of different mounting mechanisms have been proposed to achieve these variations in the seat position with respect to the horizontal plane. Many of the mechanisms have various disadvantages, such as the provision of separate pivot shafts to provide tilting of the seat both forward and backward, which makes the mechanism of large size and requires a large number of parts and, hence, increases the cost and the possibility of malfunctioning. Furthermore, the known mechanisms provide for rotation of the seat about an axis or axes located a substantial distance from the front edge of the seat bottom, which results in large vertical movements of the front edge and requires the user to change the positions of his or her legs or to change sitting posture to compensate for the change in the height of the front edge of the seat bottom.

U.S. Pat. No. 4,131,260 (Ambasz, Dec. 26, 1978) describes and shows several embodiments of chair seat mounts that provide for tilting of the chair seat both backward and forward from a neutral position. Two sets of springs bias the chair seat toward the neutral position, one set resisting backward tilting and the other forward tilting. A lock device is provided for preventing the chair seat from tilting backward.

U.S. Pat. No. 4,345,733 (Ambasz et al., Aug. 24, 1982) discloses a chair seat mount that permits a chair seat to tilt forward from a normal upright position, to which it is biased by an adjustable spring. A lock device allows the user to lock the chair seat in the forward tilted position.

The seat mounts of the aforementioned patents provide for pivoting of the chair seat about a pivot axis located very close to the column of the chair base, which means that the front edge of the seat bottom moves a relatively large distance vertically when the chair seat is tilted from the neutral position. As mentioned above, this requires the user to change his or her sitting posture when the chair seat is tilted from the neutral position.

SUMMARY OF THE INVENTION

One object of the present invention is to provide a seat-mounting mechanism that provides for both forward and backward tilting of the seat from a neutral position that is normally maintained by springs. Another object is to provide a seat-mounting mechanism in which forward and backward tilting occur with only a relatively small amount of vertical movement of the front edge of the seat bottom so that the user can keep his legs and, hence, his or her overall sitting posture, unchanged in all work positions. Yet another object is to provide a seat-mounting mechanism that permits the seat, at the option of the user, to be locked against tilting in a neutral position, a forward tilted position and a rearward tilted position. It is also to desired that the mechanism be of relatively small size, have a low number of parts, and be easy to assemble.

The foregoing and other objects are attained, according to the present invention, by a chair seat mounting mechanism having a stationary base member that is adapted to be mounted on a chair base, a seat-mounting member that is adapted to be attached to a chair seat and is rotatably attached to the base member by a pivot shaft, and springs acting between the base member and the seat-mounting member and biassing the seat to a neutral position intermediate of a forward tilted position and a rearward tilted position. The invention is characterized in that an intermediate rotating member is pivotally attached to the pivot shaft, at least one first spring is engaged between the intermediate member and the seat-mounting member such as to bias the seat-mounting member relative to the intermediate member toward the neutral position and to permit the seat to tilt forward against the bias, and at least one second spring is engaged between the base member and the seat-mounting member such as to bias the seat-mounting member relative to the intermediate member toward the neutral position and to permit the seat to tilt rearward against the bias.

In a preferred embodiment, the pivot shaft is spaced apart a substantial distance from the center of the chair seat in the direction of the front edge of the seat bottom so as to limit the amount of vertical motion of the front edge when the seat tilts forward and backward from the neutral position. Interengageable stop surfaces act among the members for limiting the amounts of rotation of each of them relative to the others and establishing maximum forward and rearward tilt positions. A lock device prevents movement of the seat-mounting member relative to the base member and is selectively operable by the user to fix the seat in the neutral position, a maximum rearward tilted position and a maximum forward tilted position. The lock device includes an abutment on the base member and a lock member movably mounted on the seat-mounting member, the lock member having spaced-apart surfaces, each of which is engageable individually with the abutment in a different one of the fixed positions of the seat-mounting member upon movement of the lock plate relative to the seat-mounting member to a locking position and is clear of engagement with the abutment upon movement to a release position.

It is also an object of the present invention to provide a simplified version of the above-described seat mount assembly that uses most of the same components but provides for only forward tilting of the chair seat from an upright position. A chair seat mounting mechanism of the simplified form also has a stationary base member adapted to be mounted on a chair base, a seat-mounting member that is adapted to be attached to a chair seat and is rotatably attached to the base member by a pivot shaft and at least one spring acting between the base member and the seat-mounting member and biassing the seat to an upright position. The invention is characterized in that the pivot shaft is spaced apart a substantial distance from the center of the chair seat in the direction of the front edge of the seat bottom so as to limit the amount of vertical motion of the front edge of the seat bottom when the seat tilts forward from the neutral position against the bias of the spring.

In a preferred embodiment of the modified form of the invention, stop elements act between the members to limit the amount of rotation of seat-mounting member relative to the base member and establish an upright position and a maximum forward tilt position. A lock mechanism prevents movement of the seat-mounting member relative to the base member and is selectively operable to fix the seat in the upright position and the maximum forward tilted position. The lock mechanism includes an abutment on the base member and a lock member movably mounted on the seat-mounting member, the lock member having spaced-apart surfaces, each of which is engageable individually with the abutment in a different one of the fixed positions of the seat-mounting member upon movement of the lock member relative to the seat-mounting member to a locking position and is clear of engagement with the abutment upon movement to a release position. The seat-mounting member has a spring seat portion having a hole. A threaded shaft having a knob affixed to it passes through a hole in the base member and the hole in the spring support portion and receives a threaded spring retainer, and the spring is engaged between the spring seat portion and the spring retainer, the spring force being adjustable by rotation of the shaft such that the retainer is moved along the shaft to change the spring force. The base member has a socket portion adapted to receive a column member of a chair base. The spring seat portion of the seat-supporting member, the spring and the shaft are located in front of the socket to facilitate operation by the user of the adjustment knob.

Preferred embodiments of the present invention have many advantages over previously known chair seat mounting mechanisms. The present invention provides improved comfort for the user by minimizing the amount of vertical movement of the front edge of the seat bottom when the inclination of the seat is changed. Accordingly, the user does not have to change the position of his or her legs or slide forward or backward on the seat bottom when changing the inclination. In the backward tilt position, the front of the seat bottom does not apply pressure to the backs of the user's legs. The user is given the choice of locking the seat in a desired position or leaving it unlocked so that it automatically moves to different positions in response to forces applied to it by the user when he or she changes sitting posture. It is important to avoiding fatigue for a office worker to change seating posture from time to time, thereby moving the muscles and in many positions stretching and tensing the muscles. The mechanism allows the user to easily alter the configuration of the chair to attain a desired posture and a desired relationship between the chair seat position and the forces he or she applies to it. The ability to lock the chair in the forward tilted position is especially beneficial to users who operate a keyboard located, as is conventional, at a lower height than the top of a standard desk The present invention is of compact construction and fits into a small volume under the center of the seat bottom. It does not present an unsightly appearance—indeed, the outer shape can be made to fit the contour of the underside of the seat. The location of the spring-adjustment knob in front of the column of the chair base makes it easy to reach and operate. Likewise, the operating arm of the lock mechanism is conveniently located, and the mechanism is easy to operate.

For a better understanding of the invention, reference may be made to the following description of exemplary embodiments, taken in conjunction with the accompanying drawings.

DESCRIPTION OF THE EMBODIMENTS

Figure 1:
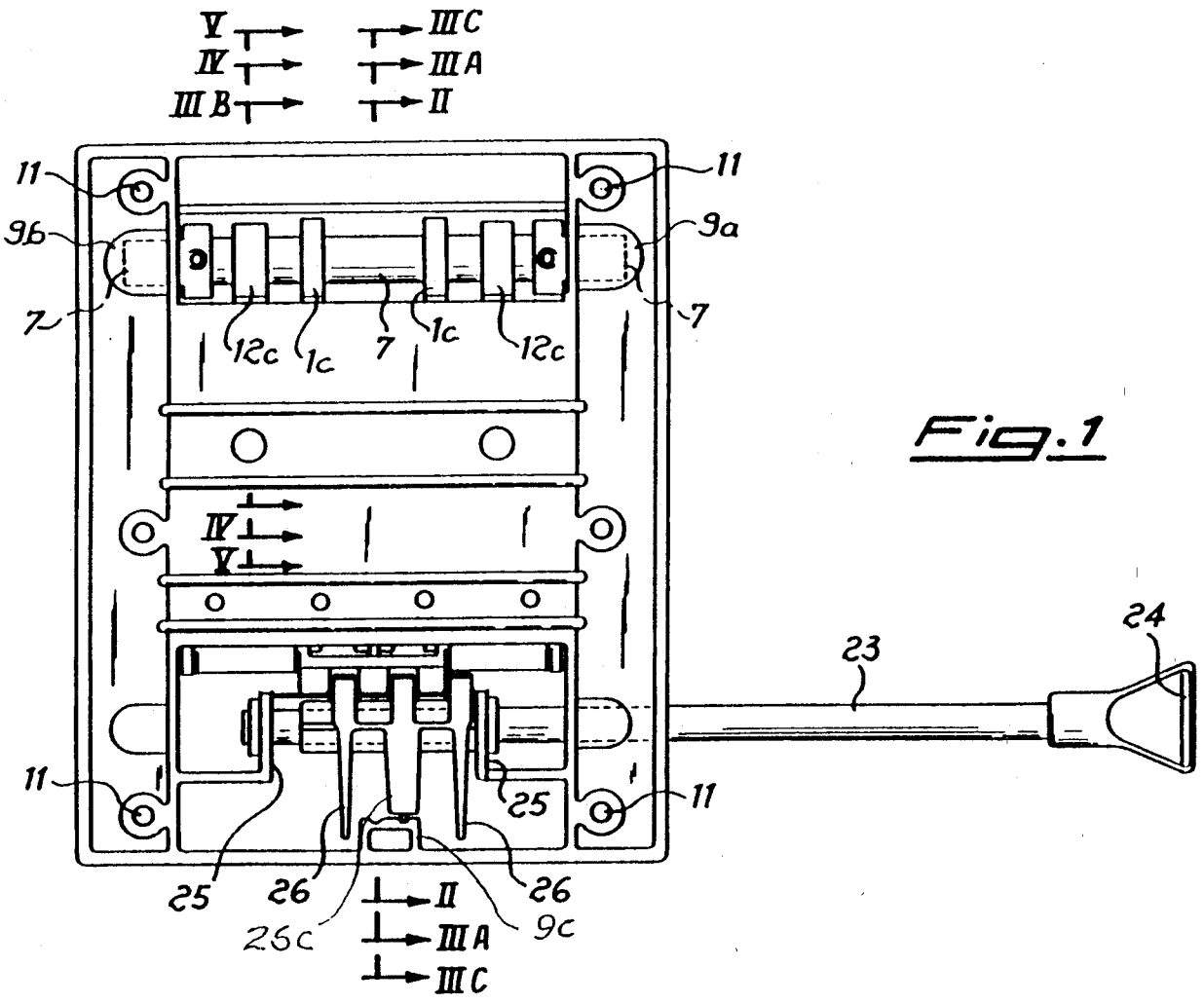
FIG. 1 is a top plan view of—embodiment.
Figure 2:
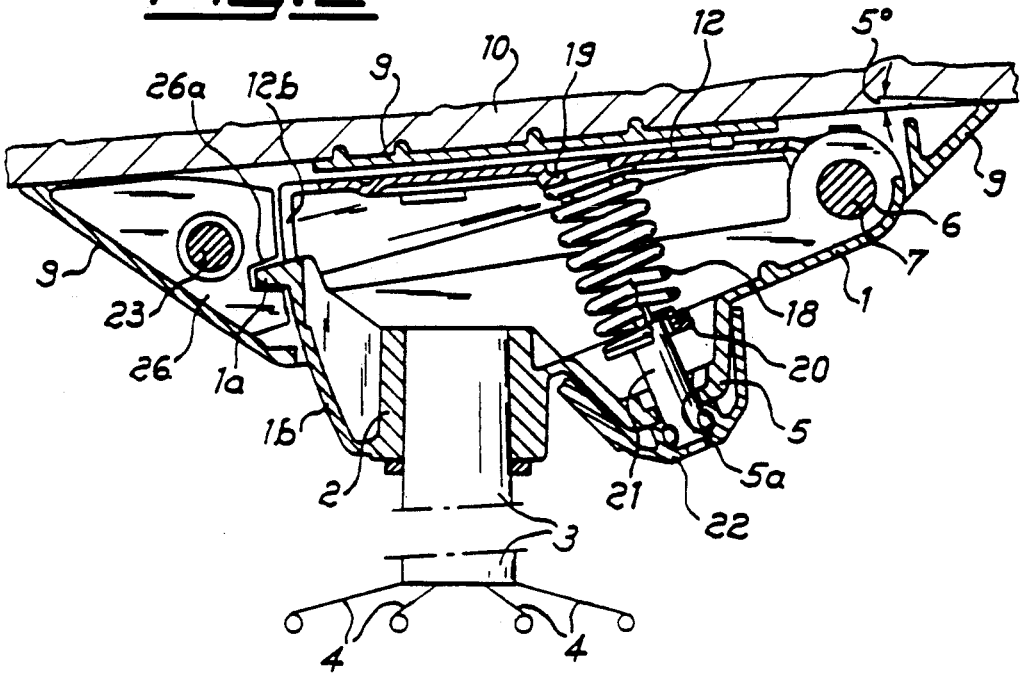
FIG. 2 is a side cross-sectional view of the embodiment of FIG. 1, taken along the lines II—II of FIG. 1.

As FIGS. 1 and 2 show, one embodiment of the chair seat mounting mechanism, according to the present invention, comprises a stationary base member 1 having a sleeve portion 2 that defines a vertical socket that is adapted to receive a support column 3 of a pedestal base of the type commonly used for office chairs and having radially extending legs 4 with casters. Immediately in front of the sleeve of the stationary member 1 is a cup-shaped projection 5 provided with a center hole 5*a* and having its axis inclined with respect to the axis of the support column 3. At the front end of the member I, and located a substantial distance in front of the column 3, are a pair of laterally spaced-apart vertical flanges 1*c* with aligned holes 6 that receive a pivot shaft 7. The shaft 7 extends laterally outwardly on both sides beyond the flanges 1*c* and receives rotationally a pair of spaced apart vertical sleeves 9*a*, 9*b* of a seat-mounting member 9, which is adapted to be affixed to the underside of a chair seat bottom 10 by means of screws passing through fastening holes 11.

Received between the stationary base member 1 and the seat-mounting member 9 of the mechanism is a pivotable intermediate member 12, the front end of which is pivotally coupled by means of curved flanges 12*c* to the pivot shaft 7. The back end 12*b* of the member is free and has inturned stop flanges 12*a* (FIG. 3B) that are located so as to engage the undersides of a stop flanges 1*b* on the base member 1 when pivoted clockwise about the shaft 7 under the bias of springs (described below).

Located in the space between the base member 1 and intermediate member 12 are two sets of springs, one set of which biases the seat-mounting member 9 counterclockwise about the pivot shaft 7 relative to the intermediate member 12 and the other set of which biases the intermediate member 12 clockwise about the pivot shaft 7 relative to the base member 1. The first set consists of two springs 13 (see FIG. 3*b*) located symmetrically on opposite sides of the front to back center line of the mechanism and engaged between seats 14 on the member 12 and spring retainers 15 threaded onto screws 16, the heads 16*a* of which bear against the top of the member 9. The screws enable the preload of springs 15 to be adjusted when the mechanism is assembled.

The second set of springs consists of two non-adjustable springs 17 (see FIG. 3*b*) located symmetrically on opposite sides of the centerline of the mechanism and an adjustable spring 18 located in the lateral center of the mechanism (see FIG. 2). Each spring 17 is held in place at each end by a flange that forms a seat. The upper end of the spring 18 engages a seat 19 on the intermediate member 12, and the lower end engages a spring retainer 20 that is rotatably received on a threaded shaft 21. The shaft threads into a hole 5*a* in the cup-shaped portion 5 of the base member I has a knob affixed to it. The user can adjust the force applied by the spring by turning the knob.

The mechanism, according to the invention, also includes a mechanical locking device for locking the chair seat in different positions. The locking device includes an operating arm 23 provided at its outside end with a handle 24 and extending laterally into the seat-mounting member 9. It is received for lengthwise movement in holes in flanges 25 on the seat-mounting member and has affixed to it a lock member having two plate portions 26 that are shaped at their rearward portions (to the left in the figures) in profile (see FIG. 2, for example) to engage the member 9 so that the lock member cannot rotate. Each plate portion has a groove 26*a* that is engageable with a corresponding abutment 1*a* that projects rearwardly from the base member 1. The upper and lower edges at the fronts of the plate portions 26 are also engageable with the abutments 1*a*. The abutments are laterally spaced apart. When the operating arm 23 is pulled out laterally away from the base member 1, the position shown in FIG. 1, the plate portions 26 of the locking device are received in the spaces between the abutments 1*a*, which is the unlocked position of the locking device. When the operating arm is pushed in, which is the locked condition of the locking device, the plate portions engage the abutments in a selected one of three positions of the mechanism, namely, a neutral, relatively upright position, a backward tilt position and a forward tilt position. The locked and unlocked conditions are retained against moderate forces on the operating arm 23 by a detent acting between a center plate portion 26*c* and a grooved boss 9*c* on the seat-mounting member (see FIG. I). The front part of the center plate portion 26*c* of the lock member also works with the center abutment la of the base member.

Figure 3A:
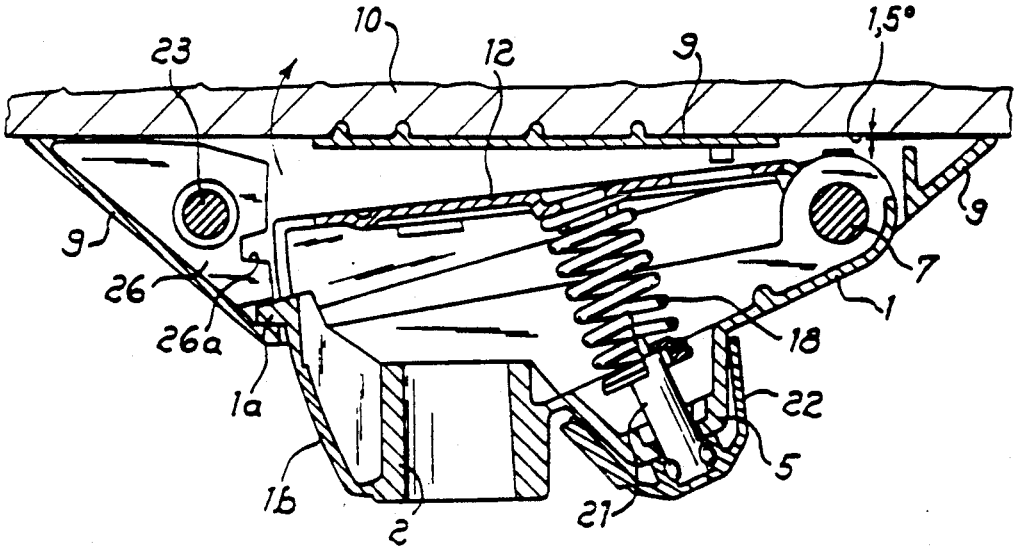
FIGS. 3*a*, 3*b* and 3*c* and 4 are side cross-sectional views taken along the lines IIIA—IIIA, IIIB—IIIB, IIIC—IIIC and IV—IV, respectively, of FIG. 1 and also show the mechanism in difference positions.
Figure 3B:
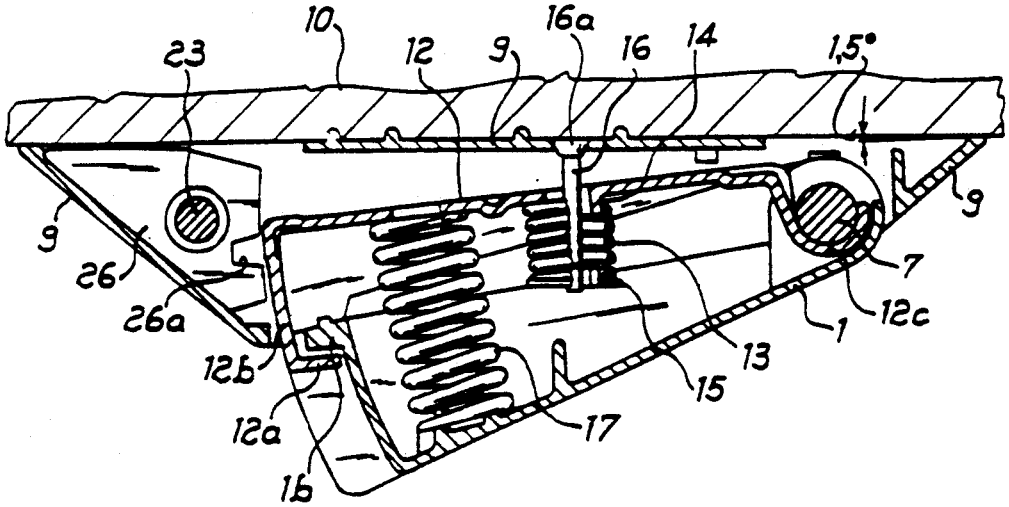
Figure 3C:
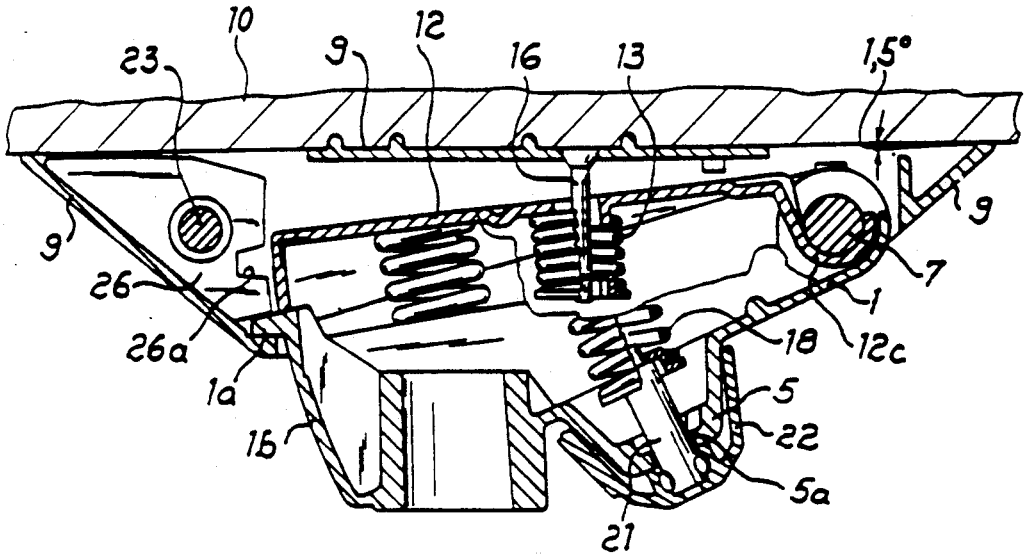
Figure 4:
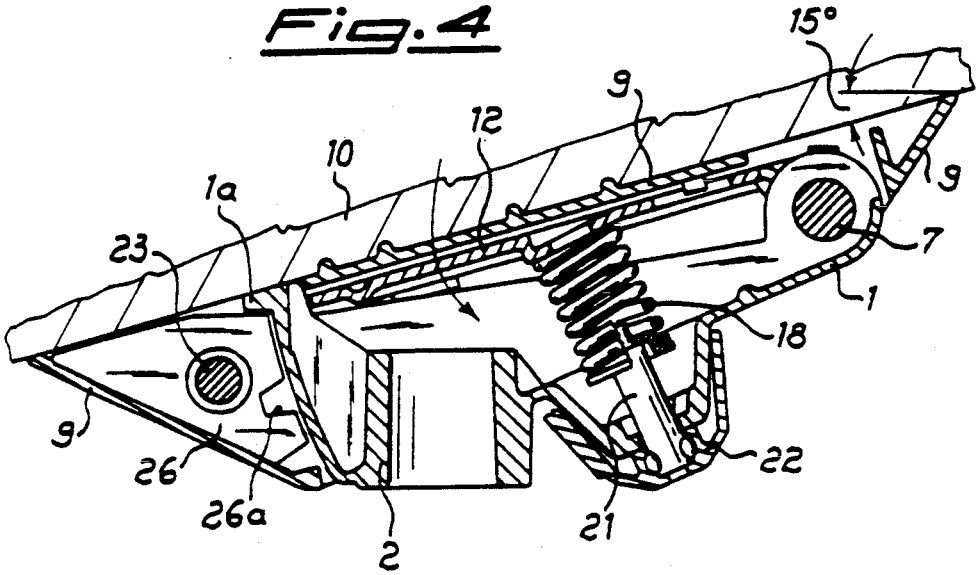

The device according to the invention functions as follows:

when the user assumes a relatively upright sitting posture, the chair seat is biassed by the two sets of springs to the neutral position shown in FIG. 2. The springs 13 pull the seat-mounting member down, such that it engages the top of the intermediate member. The springs 17 and 18 push the intermediate member up relative to the base member 1 to a stop position corresponding to the neutral position of the chair seat maintained by engagement of the stop flanges 12*a* on the seat-mounting member with the stop flanges 1*b* (FIG. 3*b*) on the base member. In the neutral position, the seat bottom slopes down slightly from front to back at an angle of about 5° with respect to the horizontal. The seat can be locked in the neutral position by pushing the operating arm in (to the left in FIG. 1 from the position shown in FIG. 1), which moves the lock member to a position in which the abutments la are received in the notches 26*a* (FIG. 2) of the plate portions 26 and 26*c*. If the seat is unlocked by pulling the operating arm out, the user can apply forces to the chair seat by changing his or her seating posture that cause the seat to tilt either backward or forward against the biassing forces of the respective springs.

if the user leans forward, such as to operate a keyboard, the springs 13 will yield to the force applied by the user to the seat and allow the seat-mounting member to pivot clockwise about the pivot shaft 7 to the forward tilted position shown in FIG. 3*b*. The maximum forward tilt position is a rearward slope of the seat bottom of about 1.5° to the horizontal. In the forward tilt position, the intermediate member 12 remains stationary, stopped by engagement of the flanges 12*a* of the intermediate member against the flanges 1*b* of the base member 1. If desired, the user may lock the seat in the forward tilt position by pushing in the operating arm 23, thereby causing the abutments 1*a* to be engaged by the lower front edges of the corresponding plate portions 26 of the locking device, as shown in FIG. 3*c*. In the full forward tilt position, there is enough clearance between the abutments 1*a* and the plate portions 26 to enable the plate portions to slide into the lock position.

if the user leans back in the chair from the neutral position (FIG. 2), the chair seat tilts backward to any desired extent up to a maximum rearward slope of the seat bottom of about 15° (FIG. 4). The force applied by the user's body to the chair seat in leaning back is transmitted from the seat-mounting member 9 to the intermediate member 12 and overcomes the forces of the springs 17 and 18, thereby enabling the members 9 and 12 to pivot together counterclockwise about the pivot shaft 7. The maximum backward tilt position is established by engagement of portions 12*d* of the top wall portion of the intermediate member 12 near the junctures with the rear flanges 12*b* with portions of the upper edge of the stop flanges 1*b* of the base member 1—one of the aforementioned portions 12*d* is visible in FIG. 3*b*, where it can be seen that the flange 1*b* acts as a stop in conjunction with the portions 12*a* and 12*d* of the base member to limit the range of pivoting of the intermediate member relative to the base member. If desired, the user can lock the chair seat in the maximum backward tilt position by pushing in the operating arm 23, which moves the plate portions of the lock member 9 into engagement with the undersides of the abutments la, as shown in FIG. 4.

The force required to be exerted by the user to move the seat to the backward tilt position can be varied to suit the user's desire by adjustment of the force of the spring 18, using the knob 22 to turn the threaded shaft 21 and either tighten or loosen the spring 18.

It is apparent from the above description that the mechanism for providing changes in the inclination of the seat of an office chair, according to the present invention, has a single shaft 7 for both rotations, clockwise (forward) and counterclockwise (backward), which is located a substantial distance in front of the column of the chair base in the direction of the front edge of the seat 10. Accordingly, the amount of vertical movement of the front edge of the seat is limited, and it is not necessary for the user to change the position of his or her legs and sitting posture when the inclination of the seat is changed. The mechanism is compact in size and fits unobtrusively under the center of the seat bottom within a small area and a small volume.

Figure 5:
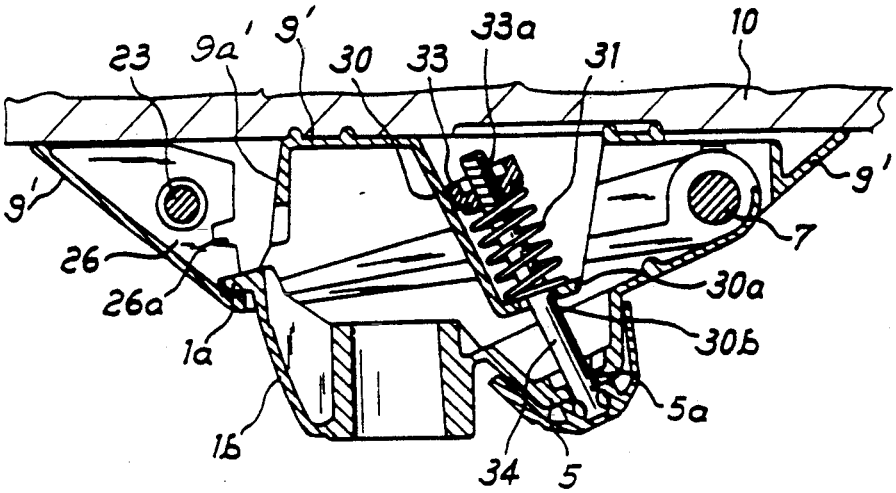
FIG. 5 is a side cross-sectional view of a second embodiment.

FIG. 5 illustrates an embodiment of a simplified mechanism, which affords the possibility of rotating only clockwise, i.e., to a forward tilt position from an upright position—the feature of backward tilting is eliminated. It uses many of the same components, which are given the same reference numerals in FIG. 5 as the embodiment of FIGS. 1 to 4.

The intermediate member 12 and the springs 13, 17 and 18 are not used, and a seat-mounting member 9' of a modified form replaces the member 9 of the first embodiment. The member 9' has a downwardly depending flange portion 30 having a spring seat portion 30*a* at its lower end. A threaded shaft 34 having a knob affixed at its outer end extends through a hole 30*b* in the spring seat portion and receives a spring retainer 33 having threads 33*a* received on the threads of the shaft 34. A spring 31 is compressed between the retainer and the seat portion. By rotating the shaft 34 by means of the knob, the user can adjust the spring force; the retainer 33 is prevented from rotating by engagement of a flat surface on one side with the flange 30, so the retainer is moved along the shaft 34 to tighten or loosen the spring.

FIG. 5 shows the embodiment in the forward tilt position. As in the first embodiment, the seat can be locked in that position by pushing the arm 23 in, which causes the lower front edges of the plate portions 26 and 26*c* to engage the corresponding abutments 1*a*. When the arm 23 is pulled out, the mechanism is unlocked. If the user leans back from a forward posture, the seat-mounting member 9' pivots counterclockwise about the pivot shaft 7, aided by the force of the spring 31. An upright position of the seat is established by engagement of the lower edges of rear flange portions 9*a'* of the member 9' with the upper edges of the stop flanges 1*b* of the base member. The chair can be locked in the upright position against forward tilting by the lock mechanism, the abutments 1*a* being engaged in the notches 26*a* of the locking device.

I claim:

1. A chair seat mounting mechanism for enabling a chair seat to tilt forward and backward from a neutral position comprising a stationary base member adapted to be mounted on a chair base, a seat-mounting member that is adapted to be attached to a chair seat and is pivotally attached to the base member by a pivot shaft, an intermediate member pivotally attached to the pivot shaft, at least one first spring coupled between the intermediate member and the seat-mounting member such as to bias the seat-mounting member relative to the intermediate member about the pivot shaft in a direction such as to lower the rear of the seat relative to the front and to permit the seat to tilt forward relative to the intermediate member against the bias of the first spring, and at least one second spring coupled between the base member and the intermediate member such as to bias the intermediate member and the seat-mounting member in tandem in a direction such as to raise the rear of the seat relative to the front and to permit the seat to tilt rearward against the bias of the second spring.

2. A chair seat mounting mechanism according to claim 1 wherein the pivot shaft is spaced apart a substantial distance from the center of the chair seat in the direction of the front edge of the seat bottom so as to limit the amount of vertical motion of the front edge when the seat tilts forward and backward from the neutral position.

3. A chair seat mounting mechanism according to claim 1 and further comprising stop means acting among the members for limiting the amounts of rotation of each of them relative to the others and establishing maximum forward and rearward tilt positions of the seat.

4. A chair seat mounting mechanism according to claim 1 and further comprising lock means for preventing movement of the seat mounting member relative to the base member and selectively operable to lock the seat in the neutral position, a maximum rearward tilted position and a maximum forward tilted position.

5. A chair seat mounting mechanism according to claim 1 wherein the lock means includes an abutment on the base member and a lock member movably mounted on the seat-mounting member, the lock member having spaced-apart surfaces, each of which is engageable individually with the abutment in a different one of the fixed positions of the seat-mounting member upon movement of the lock member relative to the seat-mounting member to a locking position and is clear of engagement with the abutment upon movement to a release position.

6. A chair seat mounting mechanism comprising a stationary base member adapted to be mounted on a chair base, a seat-mounting member that is adapted to be attached to a chair seat and is pivotally attached to the base member by a pivot shaft, at least one spring acting between the base member and the seat-mounting member and biassing the seat to an upright position, the pivot shaft being spaced apart a substantial distance from the center of the chair seat in the direction of the front edge of the seat bottom so as to limit the amount of vertical motion of the front edge of the seat bottom when the seat tilts forward from the upright position against the bias of the spring, and lock means for preventing movement of the seat-mounting member relative to the base member and selectively operable to lock the seat in the upright position, the lock means including an abutment on the base member and a lock member movably mounted on the seat-mounting member, the lock member having spaced-apart surfaces, each of which is engageable individually with the abutment in a different one of the fixed positions of the seat-mounting member upon movement of the lock member relative to the seat-mounting member to a locking position and is clear of engagement with the abutment upon movement to a release position.

7. A chair seat mounting mechanism according to claim 6 and further comprising stop means acting between the members for limiting the amount of rotation of seat-mounting member relative to the base member and establishing the upright position and a maximum rearward tilt position.

8. A chair seat mounting mechanism according to claim 6 wherein the seat-mounting member has a spring seat portion having a hole, a threaded shaft having a knob affixed to it passes through a hole in the base member and the hole in the spring seat portion and receives a spring retainer, and the spring is engaged between the spring retainer and the spring seat portion, the spring force being adjustable by rotation of the shaft such that the spring retainer is moved along the shaft to change the spring force.

9. A chair seat mounting mechanism according to claim 8 wherein the base member has a socket portion adapted to receive a column member of a chair base, in that the spring seat of the seat-supporting member, the spring and the shaft are located in front of the socket to facilitate operation by the user of the adjustment knob.

* * * * *